US005820887A

United States Patent [19]

Mogel

[11] Patent Number: 5,820,887

[45] Date of Patent: Oct. 13, 1998

[54] APPARATUS FOR SLIP FORM PRODUCTION OF PRESTRESSED CONCRETE RAILROAD TIES

[76] Inventor: Richard L. Mogel, 3418 Cypress Way, Santa Rosa, Calif. 95405

[21] Appl. No.: 828,150

[22] Filed: Mar. 27, 1997

Related U.S. Application Data

[62] Division of Ser. No. 510,964, Aug. 3, 1995, Pat. No. 5,618,476.

[51] Int. Cl.[6] ..... B28B 1/08; B28B 7/14

[52] U.S. Cl. ..... 425/64; 425/63; 425/111; 425/117; 425/150; 425/308; 249/83; 249/86

[58] Field of Search ..... 425/63, 64, 62, 425/111, 117, 150, 126.1, 453, 308; 264/40.1, 70; 249/86, 83

[56] References Cited

U.S. PATENT DOCUMENTS

| | | | |
|---|---|---|---|
| 4,051,216 | 9/1977 | Bratchell | 264/157 |
| 4,076,474 | 2/1978 | Catenacci | 425/64 |
| 4,102,957 | 7/1978 | Da Re | 425/111 |
| 4,105,392 | 8/1978 | Arer et al. | 425/111 |
| 4,253,817 | 3/1981 | Stinton et al. | 425/447 |
| 4,255,104 | 3/1981 | Stinton | 425/111 |
| 4,290,991 | 9/1981 | Thim | 425/111 |
| 4,378,203 | 3/1983 | Nayagam | 425/150 |

*Primary Examiner*—Khanh P. Nguyen
*Attorney, Agent, or Firm*—Townsend and Townsend and Crew

[57] ABSTRACT

Pre-stressed concrete railroad ties are manufacture by the slip form process in the absence of mold members, other than the slip form itself. Tie casting occurs on a portable casting soffits between portable soffit anchored deadmen supporting the pre-stressed tie tensile members immediately overlying the casting soffit. Tie formation occurs with the slip form passing around and over the pre-stressed tension members. Track fastening hardware is vibrationally inserted through windows of the slip form to place the track fastening hardware to precise measured dimension along the route of slip form movement and to configure that portion of the tie adjacent the track fastening hardware. End of tie locations as well as tie batch identification are likewise marked during the slip form process. Upon cure, the ties are cut at their marked end location. Provision is made to place the track fastening hardware into high strength modular inserts which are later being modularly inserted to the tie during the slip form process.

5 Claims, 7 Drawing Sheets

SECTION A

APPARATUS FOR SLIP FORM PRODUCTION OF PRESTRESSED CONCRETE RAILROAD TIES

This is a Division of application Ser. No. 08/510,964 filed Aug. 3, 1995 now U.S. Pat. No. 5,618,476 the disclosure of which is incorporated by reference.

This invention relates to the slip form production of concrete railroad ties including specialty ties such as switch ties. Specifically, a portable apparatus and simplified process is disclosed in which slip form fabricated ties are formed over pre-tensioned tensile elements. Rail fastening systems are inserted through the slip form at precision intervals to enable simplified tie formation. The ties when cured are cut at the desired length and utilized.

BACKGROUND OF THE INVENTION

Prestressed concrete railroad ties are known. These ties include a standard trapezoidal section usually having a broad, lower, and ground facing section of the ties reinforced with pre-stressed tensile elements, cables such as wire or strand. These wires or strands exert a compression force on the concrete of the tie, especially in the lower and ground facing portions of the tie. The ties at an upper and track supporting surface are manufactured with track fastening hardware integrally formed to the tie. Once the tie is placed, the track fastening hardware enables relative rapid rail placement and holds the rail precisely in place during the life of the tie.

When the ties are subjected to service loading . . . such as where a train passes over the ties . . . the pre-stressed concrete remains in compression. In what would otherwise be portions of a conventional wooden tie under tension become portions of the pre-stressed concrete tie under reduced - - - but not eliminated - - - compression. There results a concrete tie having superior wear characteristics over its wooden counterpart.

Such ties are manufactured in forms which in most cases define the tie dimensions. In all known cases, forms locate with precision the track fastening hardware. Consequently, a review of the manufacture of concrete railroad ties utilizing forms can be instructive.

In a conventional tie forming process, paired deadmen which resist the pre-tensioning force from the cables are located at opposite ends of a casting bed. Since the tie are cast to a mold, the bottom of which is the casting soffit, and are required to be released from the mold, casting occurs with the broad ground facing portion of the tie upwardly exposed and the track supporting upper portion of the tie with its track fastening hardware facing down. This requires the prestressing tie elements, cables, be elevated a distance from the casting soffit which is a further distance from the base of the casting bed, generally the ground.

Supporting elevated cables under high tension from deadmen is not trivial. The steel elements of the ties are high-strength steel usually stressed to 75% of their ultimate strength. Where the steel elements of the ties are supported in the order of over 6" from the ground, the deadmen at either end of the casting soffit must be designed to resist considerable torque relative to the casting bed. This being the case, it is common to firmly anchor pretensioning deadmen in buried and permanent foundations especially constructed to resist torque.

The forms are placed and distributed longitudinally along the casting bed with the pre-tensioning wires passing through the forms at the respective ends of the ties. The forms define in their lower surface, receptacles for the placement of the track fastening hardware. In one common process, form ends are defined by end gate bars. Once the forms are in place, concrete is poured, usually in conjunction with a vibratory force applied to the molds for consolidating the concrete.

When sufficient solidification has occurred . . . but before complete curing occurs, the gate end bars are removed leaving defined gaps at the tie ends. Once curing is complete, concrete sawing of the tie and tensile elements occurs at the interval defined by the now removed gate end bars. The discrete ties are then collected and shipped.

Having recited a process representative of the prior art, some of the disadvantages of conventional pre-stressed concrete railroad tie construction can be set forth.

First, and because the deadmen at either end of the casting soffit must resist considerable torque, facilities that manufacture concrete railroad ties are generally not portable; most facilities constitute permanent installations with deadmen having elaborate underground foundations which can never be conveniently moved. The concrete ties themselves are not easily shipped; commonly each conventional length tie weighs in the order of 750 pounds.

Second, the forms which mold the ties are expensive. Compounding this problem, changes in either the kind or location of rail fastening hardware requires replacement of the forms. Since such forms are custom made from steel stock, such replacement is expensive. Further, it is commonly required to discretely identify ties - - - especially as to production "batch." The forms must be modified to enable this identification. Unfortunately, the placement and manner of tie identification most always varies with each tie customer.

Third, where tie lengths change, form lengths likewise must change. When it is remembered that so-called switch ties come in many differing lengths, many forms are required for a single switch installation.

Fourth, combining the capital cost of deadmen and forms with other required accessories, plants for the production of concrete railroad ties are extremely expensive. Construction of a conventional concrete tie fabrication plant has an extremely high capital cost.

Fifth, the forms must be cleaned and maintained. Cleaning is required between each casting cycle. Form maintenance is required as forms age with use. For example, it is well known that forms, especially in the vicinity of the gate end bars, have wear induced gaps with repeating use. The gaps become points of grout leakage. Grout leakage leads to inconsistent strengths in the cast tie product, especially where such leakage occurs adjacent the tensile members of the tie.

Sixth, when the ties are in use, rail seat abrasion can occur. Specifically, a vulnerable point of the tie is adjacent to the tie fastening hardware where relative abrading movement of the rail relative to the tie and track fastening hardware can occur with the dynamic loading applied by passing rail wheels and their supported loads. Since ties are commonly constructed of a single consistent grade of concrete, abrasion at the tie support surface adjacent the rail fastening hardware is a common occurrence.

Attempts have been made to simplify concrete railroad tie construction utilizing slip forms. In *Stinton et al.* U.S. Pat. No. 4,253,817 entitled CONCRETE RAILROAD TIE CASTING AND HANDLING SYSTEM, molds defining the track support surface and holding the rail fastening hardware are placed in a casting bed and slip forming occurs over the molds. The tie is slip formed in an inverted disposition relative to the molds defining the track supporting surface and holding the hardware.

It is known to use slip forms - - - at least partially - - - for the construction of pre-stressed piles or slabs.

SUMMARY OF THE INVENTION

Pre-stressed concrete railroad ties are manufactured by the slip form process in the absence of mold members, other than the slip form itself. Tie casting occurs on a portable casting soffits between portable soffit anchored deadmen supporting the pre-stressed tie tensile members immediately overlying the casting soffit. The casting soffit is the casting bed. Tie formation occurs with the slip form passing around and over the pre-stressed tension members. Track fastening hardware is vibrationally inserted through windows of the slip form to place the track fastening hardware to precise measured dimension along the route of slip form movement and to configure that portion of the tie adjacent the track fastening hardware. End of tie locations as well as tie batch identification are likewise marked during the slip form process. Upon cure, the ties are cut at their marked end location. Provision is made to place the track fastening hardware into high strength modular inserts which are later being modularly inserted to the tie during the slip form process.

Numerous advantages result from the disclosed process.

First, the plant for producing the ties is relatively portable. Since the ties are cast right side up with the ground support surface addressed to the ground and the track support surface upwardly exposed, the force of the tensile members of the tie can be disposed immediately into the casting soffit. Deadmen - - - located in either end of the casting soffit - - - can be supported to resist the required torque from modular members making up the casting soffit at either end. Buried foundations for the deadmen are not required. Further, the deadmen and casting soffit members can themselves be easily moved. The plant for the production of the railroad ties, can easily be moved to locations relatively near the site where the ties are being used. Hence, the shipping distance of the relatively heavy ties can be minimized.

Second, the forms which mold the tie exterior and position the track fastening hardware are eliminated. Changes in either the kind or location of rail fastening hardware does not require replacement of forms. Further, marking of tie dimension and identification easily occurs with slip form travel over the casting soffit.

Third, where tie lengths change, only insertion of rail fastening hardware or end of tie dimension need change. Taking the case of switch ties, change of tie dimension or track fastening hardware location does not require the construction and use of new forms.

Fourth, the capital cost of a plant for tie manufacture is reduced. This is because the cost of the soffit supported deadmen, the portable casting soffit, and single slip form is less than conventional counterparts including permanently anchored deadmen, permanent casting beds, and individual tie molds. Consequently, cost for initial entry into the production of concrete railroad ties is vastly reduced.

Fifth, there are no individual forms for each tie which must be cleaned and maintained. Moreover, the wear of forms with resultant grout leakage is virtually eliminated; ties of uniform strength properties result.

Sixth, modular inserts can be used which are pre-molded units of special "concrete" containing the rail seat fastening hardware and rail seat geometry. The special "concrete" can be formulated as required from various materials and additives such as polymers, structural composites, special aggregates, etc. to improve the performance of regular pre-stressed concrete in rail seat abrasion, chemical resistance, impact resistance, electrical resistance, etc. Regular pre-stressed concrete can be utilized elsewhere. These types of concrete will hereinafter be referred to as special "concrete."

DESCRIPTION OF THE PREFERRED EMBODIMENT

Figure 1:
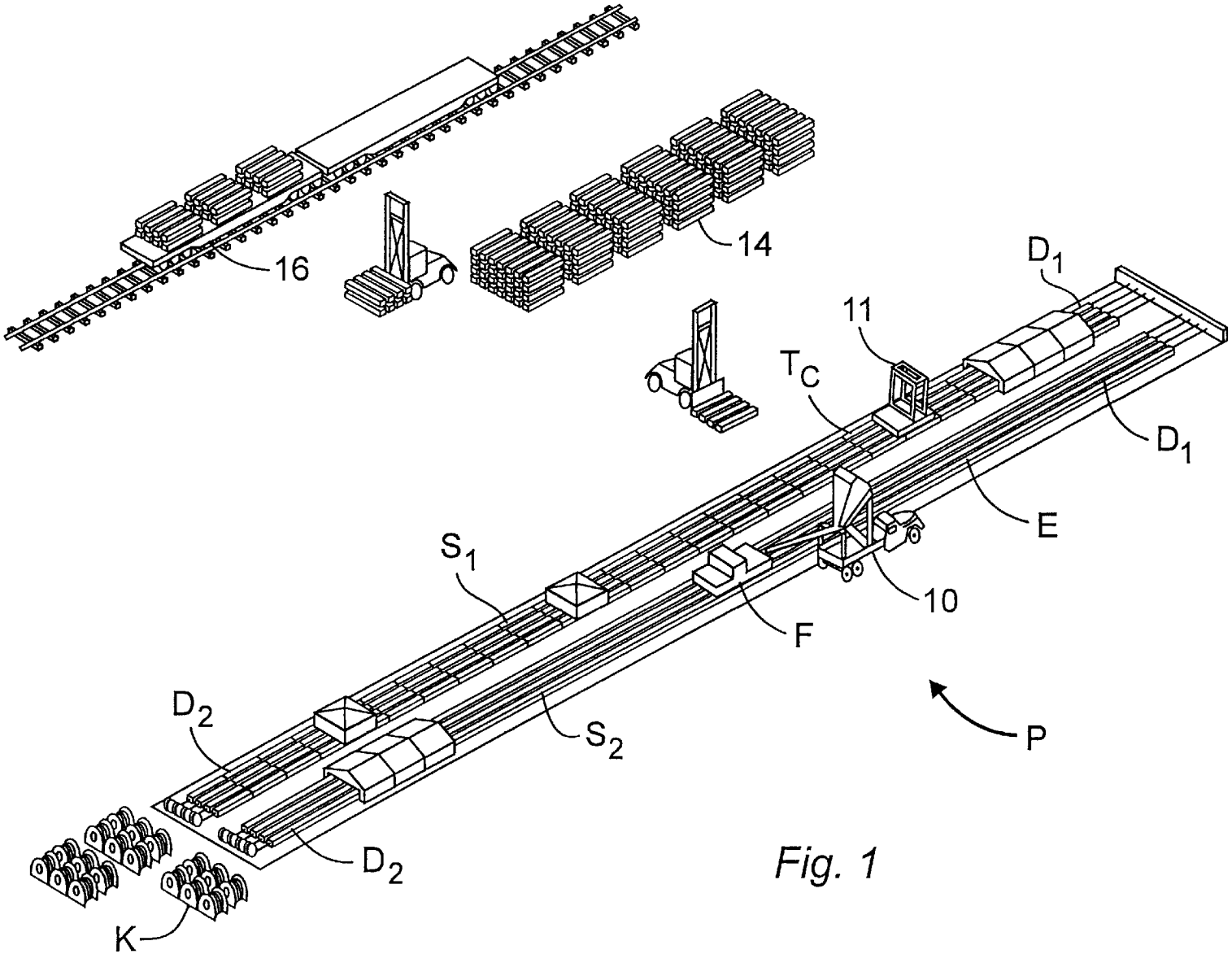
FIG. 1 is a perspective view of a facility for slip forming concrete railroad ties according to this invention illustrating soffit supported deadmen disposing tensile members over a portable casting soffit with a slip form apparatus passing over the soffit between the deadmen casting the tie section, inserting rail fastening hardware, marking end of tie location, and placing required identification.

Referring to FIG. 1, a perspective view of plant P for the production of pre-stressed concrete railroad ties T is illustrated. Pair and portable casting soffits $S_1$–$S_2$ each have respective deadmen $D_1$–$D_2$ at either end. Strand E from so-called strand packs K are conventionally threaded between deadmen $D_1$–$D_2$, placed under tension, and produce tensile elements E for the respective ties that are ultimately fabricated. (See FIG. 8)

Continuing with the perspective view of FIG. 1, truck 10 supplies concrete to slip form apparatus F on casting soffit $S_2$. Cured ties $T_c$ are shown being cut by saw 11 and removed from casting soffit $S_1$ for further ground stored curing in tie stacks 14. Thereafter, ties are eventually off loaded to rail cars 16 for transport to the track site.

Figure 2:
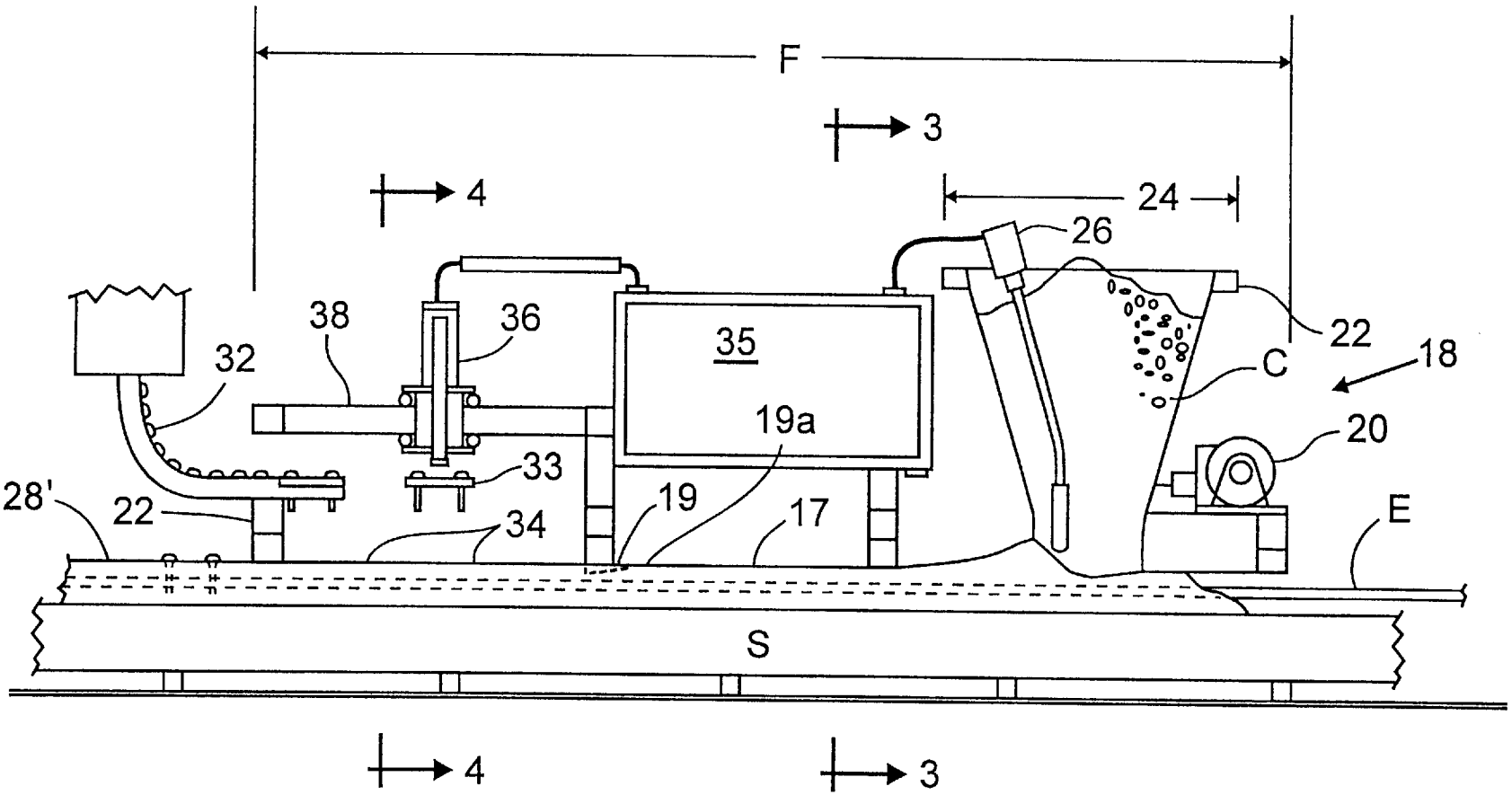
FIG. 2 is a side elevation section of the slip form apparatus including a pouring hopper, slip form, and track fastening hardware inserter passing over pre-tensioned tensile members overlying a casting soffit.

Referring to FIG. 2, slip form apparatus F is illustrated in section so that the required operational parts can be understood. Slip form 17 is placed on sled 18 and drawn by winch 20. Sled 18 is drawn over pre-tensioned tensile elements E. Sled 18 includes support frame 22 having concrete hopper 24 with a series of internal vibrators 26 for effectively fluidizing concrete C within concrete hopper 24. As slip form 17 is drawing by winch 20, concrete C is placed over pre-tensioned tensile elements E. This placement can be best understood with respect to the section of FIG. 3.

Figure 3:
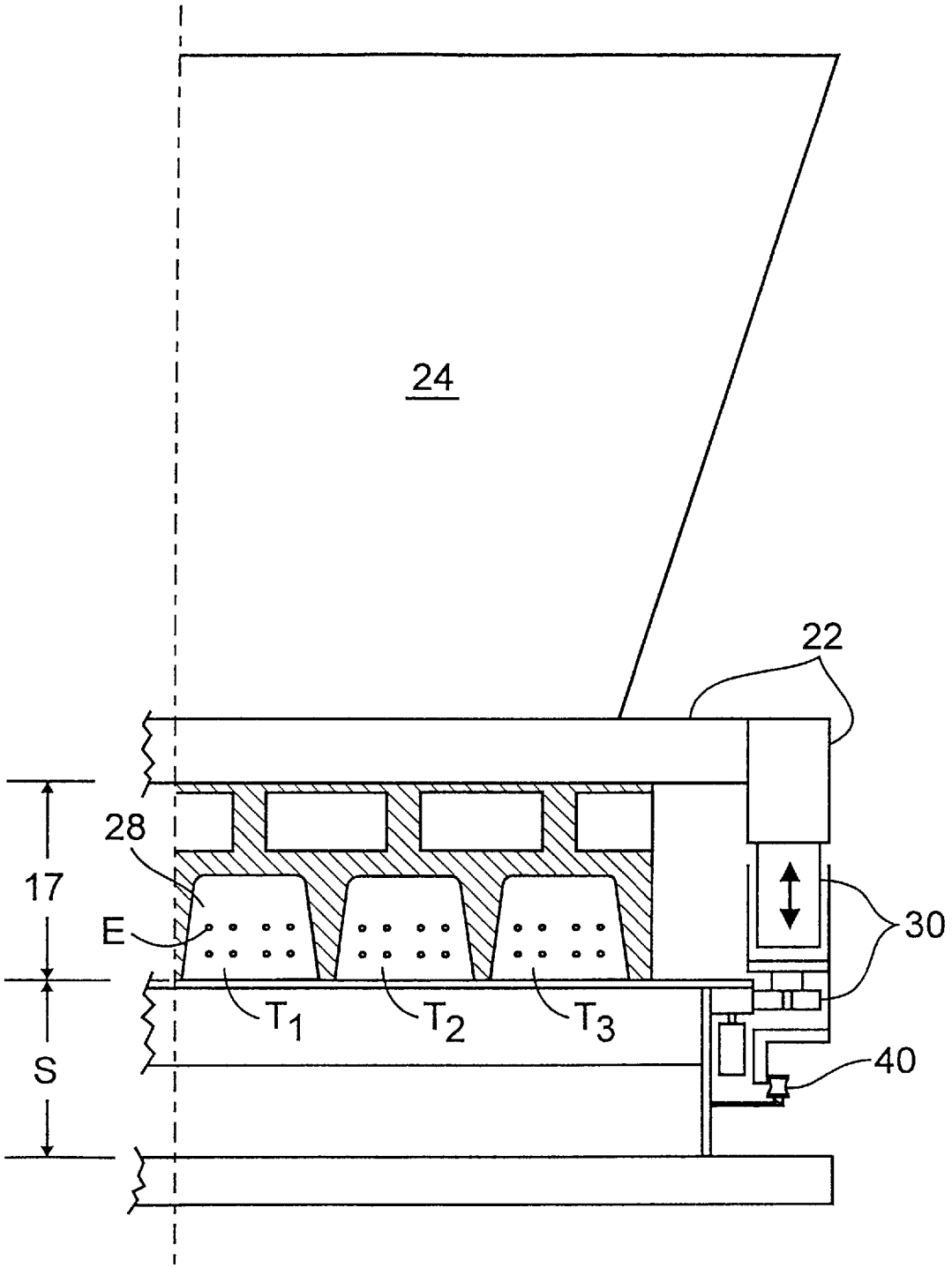
FIG. 3 is a side elevation section of the slip form apparatus along lines 3—3 of FIG. 2 illustrating slip forming passage for fabricating the full section of the tie.

Referring to FIG. 3, slip form 17 is shown forming the respective side-by-side profiles of pre-stressed concrete railroad ties $T_1$–$T_3$ at tie sections 28. In this case, three side-by-side sections are illustrated; this will represent one half the section of slip form F, the remaining three sections of the preferred embodiment not being shown.

It is required that slip form 17 guided in precise elevation overlying casting soffit S. This being the case, a guiding and clamping mechanism 30 is provided to maintain elevation, and lock the machine in place during the insertion of track supporting hardware 32.

Regarding track supporting hardware 32, several expedients are novel to this invention with respect to this hardware.

Figure 4:
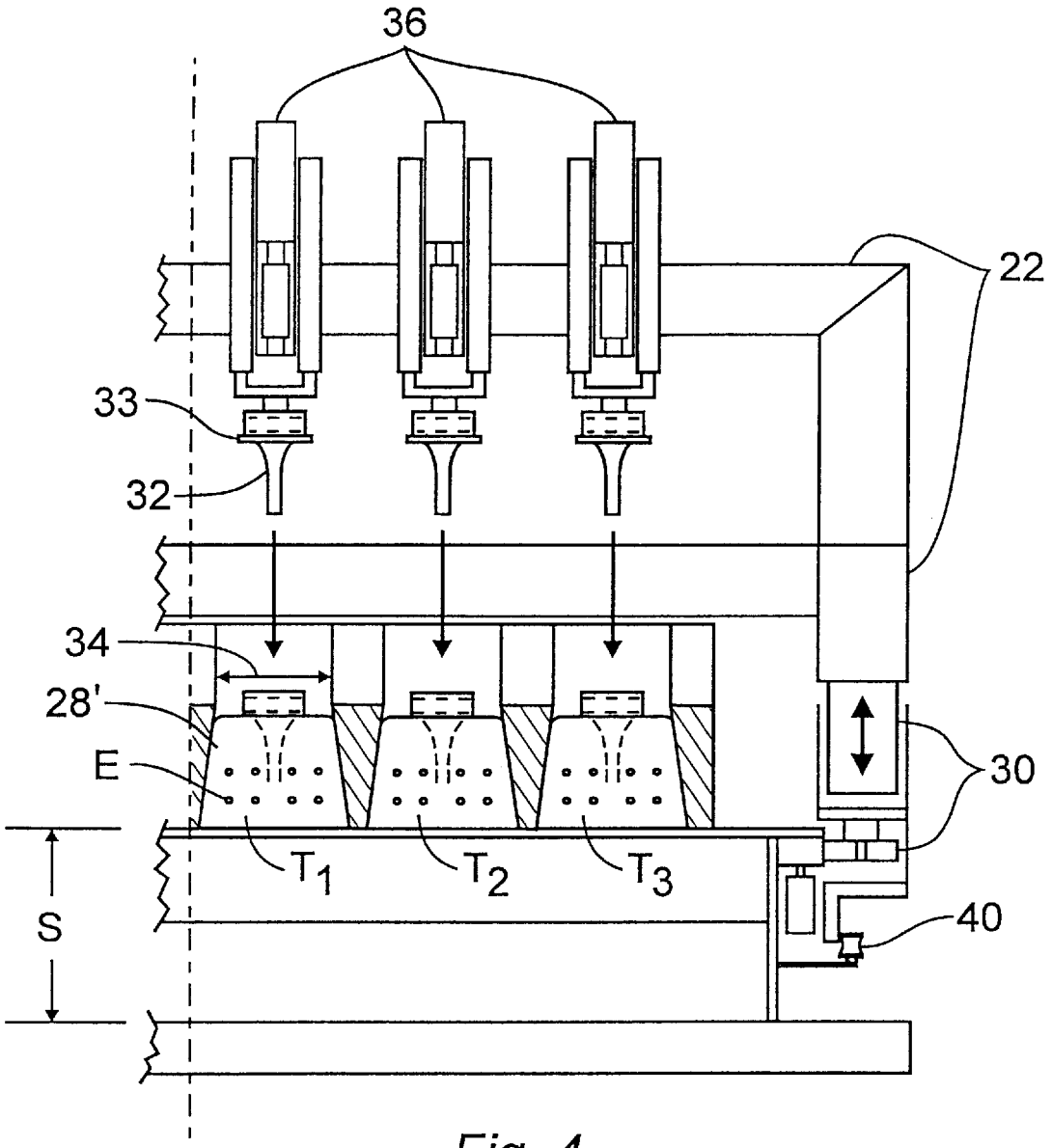
FIG. 4 is a side elevation section of the slip form apparatus along lines 4—4 of FIG. 2 illustrating insertion of track fastening hardware at windows in the slip form.
Figure 5:
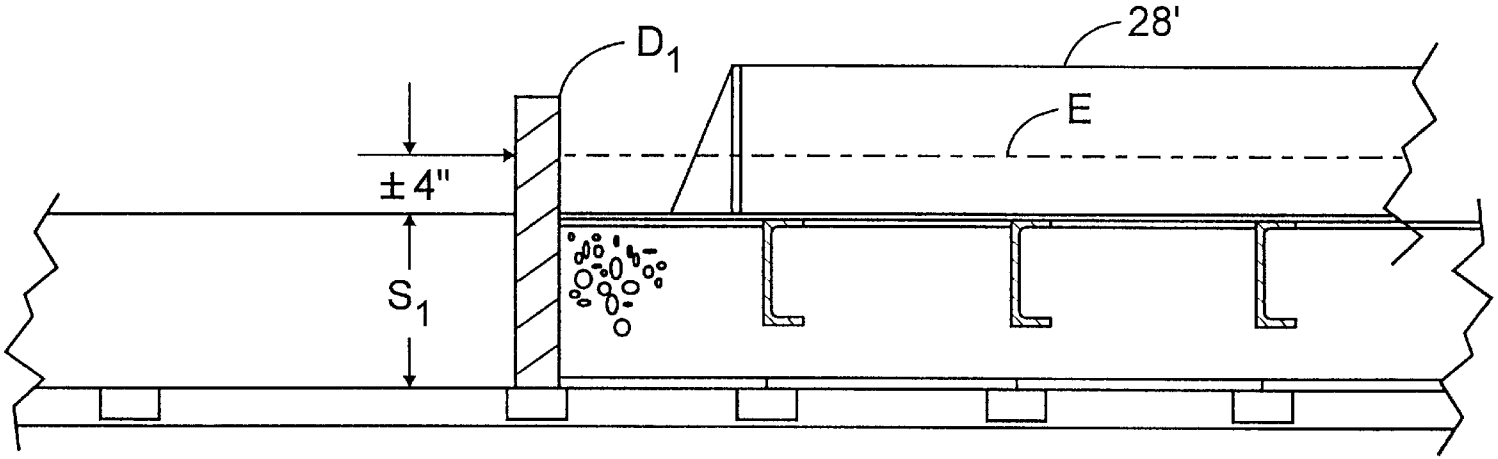
FIG. 5 is a side elevation of one of the deadman with support at the casting soffit section adjacent to the deadman against torque imposed on the deadman by the tension of the pre-stressed tie tensile elements.
Figure 6:
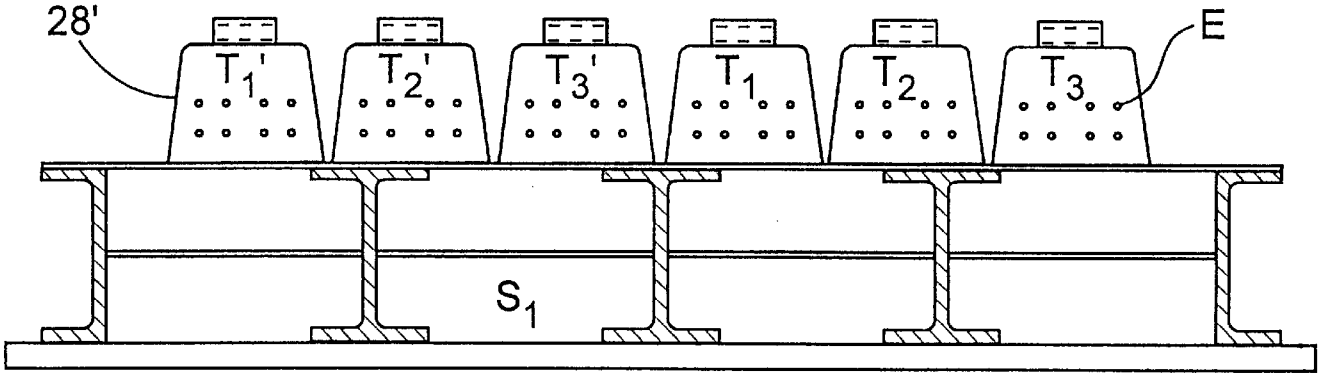
FIG. 6 is a side elevation of a portable casting soffit section.

First, the insertion of such hardware is believed to be novel. Referring to FIGS. 2 and 4, slip form apparatus F is provided with track hardware insertion window 34. Track hardware insertion units 33 are gripped by robotic arm 36 moving on support beam 38. Track hardware insertion units 33 can be either modular inserts 37 or supporting hardware 32 paired or individual. Track hardware units 33 are serially inserted through track hardware insertion window 34 as slip form apparatus F passes the length of casting soffit S.

Second it is necessary to measure with precision the distance between the respective track hardware insertion units 33. For example, in certain specifications for pre-stressed concrete railroad ties T, it is required that tolerances between respective track hardware 32 be maintained to about ⅛ of an inch. This being the case, precise robotic measurement of the insertion points of track hardware insertion units 33 is required. Apparatus for such measurement can include respective bench marks 40 on guiding and clamping mechanism 30 as monitored by computer 35 controlling robotic arm 36.

Third, slip formed concrete 28 must be vibrated in the vicinity of track hardware insertion window 34 and track hardware insertion units 33 during insertion. Accordingly, robotic arm 36 is supplied with vibrational energy during such insertion.

Figure 8:
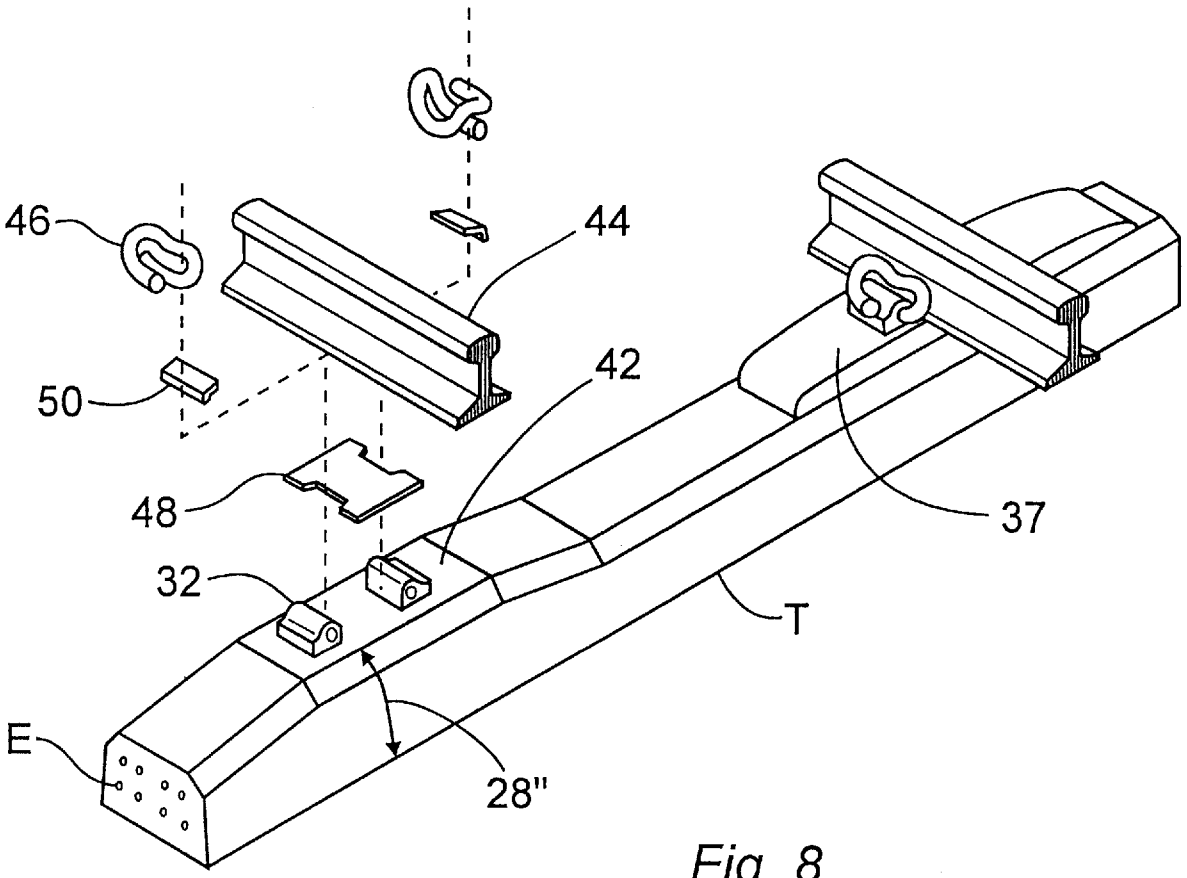

Fourth, and referring to FIG. 8, it is necessary to configure track supporting surface 42 adjacent to track hardware 32 when insertion unit 33 is not a modular insert. This being the case, robotic arm 36 can be provided with a pad surrounding track hardware 32 so as to impart the required configuration to track supporting surface 42 local to the location where rail 44 will fasten. Furthermore, for producing ties with variable depth section 28" provision is made in slip form 17 to change the section 28 by articulating the top 19 of slip form 17, about hinge 19*a*. Top 19 may be adjustably varied about hinge 12*a* as a function of travel over the casting soffit S.

With regard to such configuration, it will be noted that track hardware insertion window 34 effectively completely surrounds pre-stressed concrete railroad tie T during the required insertion. Concrete C displaced by the local configuration around track hardware insertion units 33 will be confined to the particular tie sections 28' utilized.

Figure 7B:
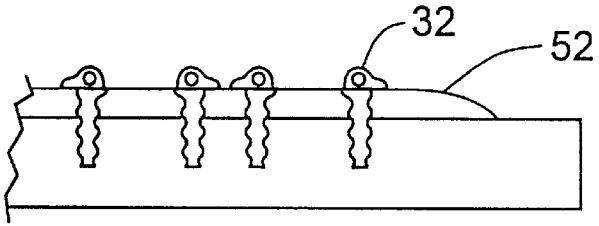
FIGS. 7A, 7B, 7C and 7D are side elevation sections of modular inserts to ties for forming a modular tie having special "concrete" in the vicinity of the track fastening hardware; and, FIG. 8 is a perspective partially exploded view of a tie manufactured according to this process, the tie here illustrating a special "concrete" modular insert on one end and illustrating regular concrete at the rail seat at the other exploded view end.
Figure 7A:
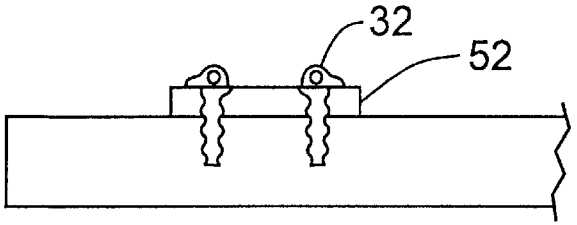

With respect to modular inserts referring to FIG. 7A, grade crossing tie $T_G$ is illustrated. In this case, paired track hardware 32 is surrounded by special "concrete" 52.

Figure 7C:
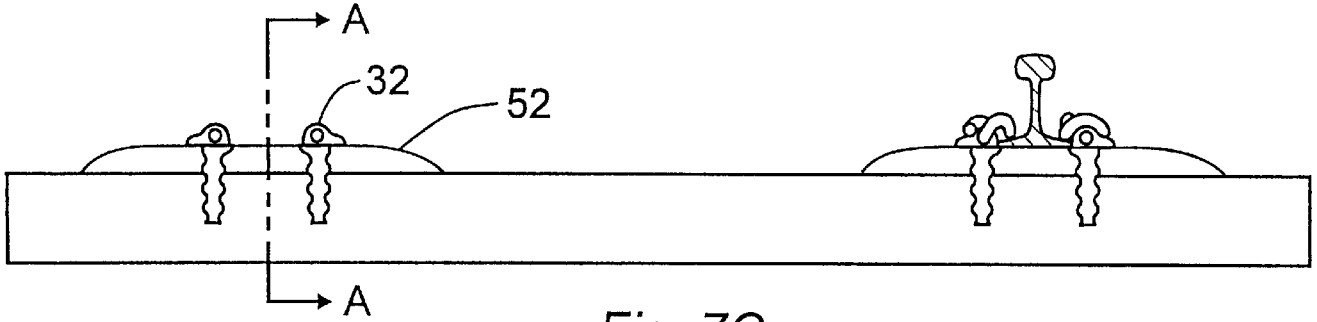
Figure 7D:
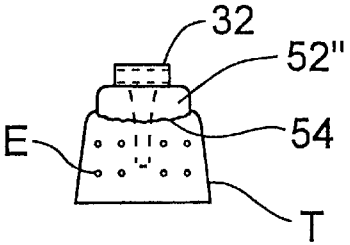

It will be understood that the configuration of the modular insert can change with respect to pre-stressed concrete railroad ties T. This is shown with respect to FIG. 7B in which a guard rail tie configuration is illustrated and FIG. 7C in which a standard tie is illustrated.

Finally, special "concrete" 52" can itself be the supporting surface for track hardware fastening system 32, 46, 48, 50. In this case, special "concrete" 52' is given an keying seat configuration 54 which when used with the disclosed vibratory insertion, effectively keys track hardware insertion modules 37 to pre-stressed concrete railroad ties T.

What is claimed is:

1. Apparatus for constructing a pre-stressed concrete railroad ties comprising:

a casting soffit;

means for disposing pre-tensioned tensile elements for the pre-stressed concrete railroad ties over the casting soffit;

a slip form for forming a tie section over the pre-tensioned tensile elements and on the casting soffit with a ground contacting section of the pre-stressed concrete railroad ties formed on the casting soffit and a track supporting section of the pre-stressed concrete railroad ties disposed upwardly and away from the casting soffit;

the slip form defining an upwardly exposed window in the slip form for insertion of track fastening hardware;

means for moving the slip form over the pre-tensioned tensile elements and the casting soffit to form ties about the pre-tensioned tensile elements supported on the casting soffit;

means for supplying the slip form with sufficient concrete to cast the tie section;

means for vibrating the concrete during the moving step;

means for measuring the movement of the slip form relative to the casting soffit to determine track fastening hardware location and end of tie location;

means for inserting track fastening hardware during the moving step to the track fastening hardware location; and means for providing a variable depth concrete tie cross section.

2. Apparatus for constructing a pre-stressed concrete railroad ties according to claim 1 and further comprising:

said means for disposing pre-tensioned tensile elements for the pre-stressed concrete railroad ties over the casting soffit includes first and second deadmen at either end of the casting soffit.

3. Apparatus for constructing a pre-stressed concrete railroad ties according to claim 1 and further comprising:

the casting soffit includes a plurality of portable soffit members.

4. Apparatus for constructing a pre-stressed concrete railroad ties according to claim 1 and further comprising:

the means for moving the slip form includes a winch.

5. Apparatus for constructing a pre-stressed concrete railroad ties according to claim 1 and further comprising:

means for cutting the ties when cured about the pre-tensioned tensile elements.

* * * * *